United States Patent [19]

Przezdziecki

[11] Patent Number: 4,741,992

[45] Date of Patent: May 3, 1988

[54] THERMALLY PROCESSABLE ELEMENT COMPRISING AN OVERCOAT LAYER CONTAINING POLY(SILICIC ACID)

[75] Inventor: Wojciech M. Przezdziecki, Rochester, N.Y.

[73] Assignee: Eastman Kodak Company, Rochester, N.Y.

[21] Appl. No.: 910,033

[22] Filed: Sep. 22, 1986

[51] Int. Cl.[4] ..... G03C 1/76

[52] U.S. Cl. ..... 430/523; 430/271; 430/348; 430/350; 430/950; 430/961

[58] Field of Search ..... 430/523, 950, 961, 271, 430/348, 350

[56] References Cited

U.S. PATENT DOCUMENTS

| | | | |
|---|---|---|---|
| 2,663,657 | 12/1953 | Miller et al. | 117/36 |
| 2,910,377 | 10/1959 | Owen | 117/36 |
| 3,028,254 | 4/1962 | Grant | 117/36.8 |
| 3,031,329 | 4/1962 | Wingert | 117/36.8 |
| 3,080,254 | 3/1963 | Grant | 117/36.8 |
| 3,457,075 | 7/1969 | Morgan et al. | 96/67 |
| 3,856,527 | 12/1974 | Hamb et al. | 430/961 |
| 3,914,522 | 10/1975 | Saverin et al. | 430/950 |
| 3,933,508 | 1/1976 | Ohkubo et al. | 96/114.1 |
| 3,993,860 | 7/1975 | Sutton et al. | 96/66 |
| 4,264,725 | 4/1981 | Reeves | 430/619 |
| 4,404,276 | 9/1983 | Steklenski | 430/961 |
| 4,423,131 | 12/1983 | Limburg et al. | 430/961 |
| 4,459,350 | 7/1984 | Przezdziecki | 430/353 |
| 4,590,148 | 5/1986 | Takahashi et al. | 430/950 |
| 4,604,635 | 8/1986 | Wiklof et al. | 346/226 |

FOREIGN PATENT DOCUMENTS 101762 12/1983 Japan .

OTHER PUBLICATIONS

Scholze et al., Journal of Non-crystalline solids, 63 (1984) pp. 1–11.

Brauer, Handbook of Preparative Inorganic Chemistry, 1963, pp. 697–699.

Research Disclosure, June, 1978, Item No. 17029.

*Primary Examiner*—Jack P. Brammer

*Attorney, Agent, or Firm*—Richard E. Knapp

[57] ABSTRACT

A overcoat layer comprising poly(silicic acid)

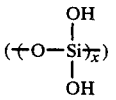

on a thermally processable element enables reduced release of volatile components from the element during thermal processing. The overcoat layer also can optionally comprise other water soluble polymers. A developed visible image is provided in an exposed silver halide photothermographic element comprising such an overcoat by uniformly heating the photothermographic element to moderately elevated temperatures without release of volatile components. The described overcoat is also useful on thermographic elements.

12 Claims, No Drawings

THERMALLY PROCESSABLE ELEMENT COMPRISING AN OVERCOAT LAYER CONTAINING POLY(SILICIC ACID)

This invention relates to a thermally processable imaging element comprising a new overcoat that enables reduced release of volatile components from the element during thermal processing and enables other advantages.

Thermally processable imaging elements, including films and papers, for producing images by thermal processing are known. These elements include photothermographic elements in which an image is formed by imagewise exposure to light followed by development by uniformly heating the element. These elements also include thermographic elements in which an image is formed by imagewise heating the element. Such elements are described in, for example, *Research Disclosure,* June 1978, Item No. 17029; U.S. Pat. No. 3,457,075; U.S. Pat. No. 3,933,508; and U.S. Pat. No. 3,080,254.

A problem exhibited by thermally processable imaging elements comprising components that are volatile at thermal processing temperatures, such as temperatures above 100° C., is that the volatile components tend to be released from the element during thermal processing. An example of this is a silver halide photothermographic film as illustrated in following comparative example A comprising a toner, such as succinimide, that has a tendency to be released from the element upon thermal development and comprising a poly(vinyl alcohol) overcoat. An example of such a poly(vinyl alcohol) overcoat is described in, for example, U.S. Pat. No. 3,933,508, U.S. Pat. No. 3,893,860, and Japanese published patent application No. 58/217930 published Dec. 19, 1983. As illustrated by comparative Example A poly(vinyl alcohol) alone does not provide an answer to this problem because it does not prevent release of the toner.

Other polymers which have been described or used as overcoats for such elements also do not fully satisfy the requirements for an acceptable overcoat. These other polymers do not satisfy one or more of the requirements that the overcoat: (a) provide resistance to deformation of the layers of the element during thermal processing, (b) prevent or reduce loss of volatile components in the element during thermal processing, (c) reduce or prevent transfer of essential imaging components from one or more of the layers of the element into the overcoat layer during manufacture of the element or during storage of the element prior to imaging and thermal processing, (d) enable satisfactory adhesion of the overcoat to a contiguous layer of the element, and (e) be free from cracking and undesired marking, such as abrasion marking, during manufacture, storage, and processing of the element. None of conventional overcoats materials, such as cellulose acetate, gelatin and fully hydrolyzed poly(vinyl alcohol) are fully satisfactory.

A continuing need has existed for an improved overcoat for a thermally processable imaging element that satisfies all the described requirements.

It has been found that the described requirements are satisfied by a thermally processable imaging element, particularly a photothermographic element or thermographic element, comprising an overcoat layer comprising poly(silicic acid). A preferred overcoat for such an element also contains a water soluble hydroxyl containing polymer, such as water soluble poly(vinyl alcohol) or water soluble cellulose derivative or monomer that is compatible with poly(silicic acid).

The poly(silicic acid) is represented by the formula:

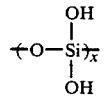

wherein X is an integer sufficient to provide a coatable aqueous solution of poly(silicic acid), such as an integer within the range of at least 3 to about 600.

Poly(silicic acid) is prepared by methods known in the organic synthesis art, such as by hydrolysis of tetraethyl ortho silicate. A typical method of preparing poly(silicic acid) comprises mixing at room temperature (20° C.) distilled water with 1N p-toluenesulfonic acid and absolute alcohol followed by mixing with tetraethyl ortho silicate. A clear solution is obtained within several minutes. The resulting solution of poly(silicic acid) is typically stable at 20° C. for more than 30 days. A 1N aqueous solution of p-toluenesulfonic acid is typically preferred in this preparation although a concentration of 0.1N to 1.0N acid can be used. Stability of the poly(silicic acid) solution is often less than optimum if a lower acid concentration is used in the preparation. Acids which are useful in place of p-toluenesulfonic acid include hydrochloric acid, sulfuric acid, and other mineral acids. A weak organic acid, such as acetic acid, can provide the desired hydrolysis, but the resulting poly(silicic acid) composition provides a gel within several hours. This gel is not conveniently coated without added mixing and preparation steps.

A useful poly(silicic acid) overcoat composition as coated does not adversely flow, smear or distort at the processing temperatures of the element, typically within the range of 100° C. to 200° C.

The optimum concentration of poly(silicic acid) in the overcoat will vary depending upon the components in the overcoat, the particular photothermographic element and processing conditions. Concentrations of poly(silicic acid) below 50% by weight when poly(vinyl alcohol) is present in the overcoat do not provide the desired degree of reduction of release of volatile components from the thermally processable element. Preferably when poly(vinyl alcohol) is present in the overcoat the concentration of poly(silicic acid) is within the range of 50% to 90% by weight of the overcoat. The optimum concentration of poly(silicic acid) can vary, depending upon such factors as the particular imaging element, thermal processing conditions, components used in combination with the poly(silicic acid) and the like.

Useful overcoat compositions comprising the poly(silicic acid) are typically transparent and colorless. If the overcoat is not transparent and colorless, then it is necessary, if the element is a photothermographic element, that is be at least transparent to the wavelength of radiation employed to provide and view the image. The overcoat does not significantly adversely affect the imaging properties, such as the sensitometric properties in the case of a photothermographic element, such as minimum density, maximum density or photographic speed.

Other components, particularly other polymers, can be useful with the poly(silicic acid) in the overcoat. Other components than can be useful in combination with poly(silicic acid) in the overcoat include, for example, other polymers, such as water soluble hydroxyl containing polymers or monomers that are compatible with poly(silicic acid), for example, acrylamide polymers, water soluble cellulose derivatives, such as water soluble cellulose acetate, and hydroxy ethyl cellulose acetate and the like. It is important that the water soluble polymer must be compatible with poly(silicic acid).

Imaging elements, particularly photothermographic and thermographic elements according to the invention can comprise, if desired, multiple polymer containing layers, particularly multiple overcoat layers. For example, an imaging element according to the invention can comprise a first overcoat layer comprising a polymer other than poly(silicic acid), such as a water soluble cellulose derivative, for example, water soluble cellulose acetate, and a second overcoat layer comprising poly(silicic acid) and another polymer.

The overcoat according to the invention is useful on any thermally processable element, particularly any photothermographic element or thermographic element, that is compatible with poly(silicic acid). The thermally processable element can be a black and white imaging element or a dye-forming thermally processable imaging element. The overcoat is particularly useful on a silver halide photothermographic element designed for dry physical development. Useful silver halide elements on which the overcoat is useful are described in, for example, U.S. Pat. Nos. 3,457,075; 4,459,350; 4,264,725 and *Research Disclosure,* June 1978, Item No. 17029. The overcoat is particularly useful on, for example, a photothermographic element comprising a support bearing, in reactive association, in a binder, (a) photographic silver halide, prepared ex situ and/or in situ, (b) an image forming combination comprising (i) an organic silver salt oxidizing agent, preferably a silver salt of a large chain fatty acid, such as silver behenate, with (ii) a reducing agent for the organic silver salt oxidizing agent, preferably a phenolic reducing agent, and (c) an optional toning agent.

A preferred embodiment of the invention comprises a photothermographic element comprising a support bearing, in reactive association, in a binder, particularly a poly(vinyl butyral) binder, (a) photographic silver halide, prepared in situ and/or ex situ, (b) an image-forming combination comprising (i) silver behenate, with (ii) a phenolic reducing agent for the silver behenate, (c) a toning agent, such as succinimide, and (d) an image stabilizer, such as 2-bromo-2-(4-methylphenylsulfonyl) acetamide, and having an overcoat according to the invention, preferably an overcoat comprising (A) poly(silicic acid) and (B) water soluble poly(vinyl alcohol) which is 80% to 99% hydrolyzed, wherein the ratio of (A) to (B) is at least 1, such as 1 to 1.5.

The overcoat is preferably applied to the thermally processable element at the time of manufacture of the element; however, the overcoat can optionally be applied to the element at any stage after preparation of the element if desired. The overcoat can, for example, optionally be applied to the element after exposure and before thermal processing.

The optimum overcoat layer thickness depends upon various factors, such as the particular element, processing conditions, thermal processing means, desired image and the particular overcoat. A particularly useful overcoat layer thickness is within the range of 1 to 10 microns, preferably 1 to 3 microns.

The photothermographic elements comprise a photosensitive component which consists essentially of photographic silver halide. In the photothermographic materials it is believed that the latent image silver from the silver halide acts as a catalyst for the described oxidation-reduction image-forming combination upon processing. A preferred concentration of photographic silver halide is within the range of about 0.01 to about 10 moles of photographic silver halide per mole of organic silver salt oxidizing agent, such as per mole of silver behenate, in the photothermographic material. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful. The photographic silver halide can be prepared by any of the procedures known in the photographic art. Such procedures for forming photographic silver halide and forms of photographic silver halide are described in, for example, *Research Disclosure,* June 1978, Item No. 17029 and *Research Disclosure,* December 1978, Item No. 17643. Tabular grain photosensitive silver halide is also useful, as described in, for example, U.S. Pat. No. 4,435,499. The photographic silver halide can be unwashed or washed, chemically sensitized, protected against the production of fog and stabilized against loss of sensitivity during keeping as described in the above Research Disclosure publications. The silver halide can be prepared in situ as described in, for example, U.S. Pat. No. 3,457,075.

The photothermographic elements typically comprise an oxidation-reduction image-forming combination which contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver salt oxidizing agents are silver behenate, silver stearate, silver oleate, silver laurate, silver hydroxystearate, silver caprate, silver myristate and silver palmitate. Combinations of organic silver salt oxidizing agents are also useful. Examples of useful silver salt oxidizing agents which are not silver salts of long-chain fatty acids include, for example, silver benzoate and silver benzotriazole.

The optimum concentration of organic silver salt oxidizing agent in a photothermographic material will vary depending upon the desired image, particular organic silver salt oxidizing agent, particular reducing agent and particular photothermographic element. A preferred concentration of organic silver salt reducing agent is preferably within the range of about 0.1 to about 100 moles of organic silver salt reducing agent per mole of Ag. When combinations of organic silver salt oxidizing agents are present, the total concentration of organic silver salt oxidizing agents is preferably within the described concentration range.

A variety of reducing agents are useful in the photothermographic materials. Examples of useful reducing agents include substituted phenols and naphthols such as bis-$\beta$-naphthols; polyhydroxybenzenes, such as hydroquinones, including hydroquinone, alkyl-substituted hydroquinones, such as tertiarybutylhydroquinone, methylhydroquinone, 2,5-dimethylhydroquinone and 2,6-dimethylhydroquinone; catechols and pyrogallols; aminophenol reducing agents, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; sulfonamidophenols and other organic reducing agents described in U.S. Pat. No. 3,933,508 and *Research Disclosure,* June 1978, Item No. 17029, the description of which is incorporated herein by reference. Combinations of organic reducing agents are also useful.

Preferred organic reducing agents in photothermographic materials are sulfonamidophenol reducing agents, such as described in U.S. Pat. No. 3,801,321. Examples of useful sulfonamidophenol reducing agent include 2,6-dichloro-4-benzenesulfonamidophenol; benzenesulfonamidophenol; 2,6-dibromo-4-benzenesulfonamidophenol and mixtures thereof.

An optimum concentration of reducing agent in a photothermographic material varies depending upon such factors as the particular photothermographic element, desired image, processing conditions, the particular organic silver salt oxidizing agent and the particular stabilizer precursor. A preferred concentration of reducing agent is within the range of about 0.2 mole to about 2.0 moles of reducing agent per mole of silver in the photothermographic material. When combinations of reducing agents are present, the total concentration of reducing agent is preferably within the described concentration range.

The photothermographic materials preferably comprise a toning agent, also known as an activator-toning agent or a toner-accelerator. Combinations of toning agents are useful in photothermographic materials. An optimum toning agent or toning agent combination depends upon such factors as the particular photothermographic material, particular components in the photothermographic material, desired image and processing conditions. Examples of useful toning agents and toning agent combinations are described in, for example, *Research Disclosure,* June 1978, Item No. 17029 and U.S. Pat. No. 4,123,282. Examples of useful toning agents include, for instance, phthalimide, N-hydroxyphthalimide, N-potassium phthalimide, succinimide, N-hydroxy-1,8-naphthalimide, phthalazine 1-(2H)-phthalazinone and 2-acetylphthalazinone.

Stabilizers which are useful in photothermographic materials include photolytically active stabilizers and stabilizer precursors as described in, for example, U.S. Pat. No. 4,459,350, and include, for instance, azole thioethers and blocked azolinethione stabilizer precursors and carbamoyl stabilizer precursors such as described in U.S. Pat. No. 3,877,940.

Photothermographic materials according to the invention preferably contain various colloids and polymers alone or in combination as vehicles, binding agents and in various layers. Useful materials are hydrophobic or hydrophilic. They are transparent or translucent and include both naturally occuring substances such as proteins, for example gelatin, gelatin derivatives, cellulose derivatives, polysaccharides, such as dextran, gum arabic and the like; and synthetic polymeric substances, such as water-soluble polyvinyl compounds like poly(-vinylpyrrolidone) and acrylamide polymers. Other synthetic polymeric compounds which are useful include dispersed vinyl compounds such as in latex form and particularly those which increase dimensional stability of photographic materials. Effective polymers include water insoluble polymers of alkylacrylates and methacrylates, acrylic acid, sulfoalkylacrylates and those which have cross-linking sites which facilitate hardening or curing. Preferred high molecular weight materials and resins include poly(vinylbutyral), cellulose acetate butyrate, poly(methylmethacrylate), poly(vinylpyrrolidone), ethyl cellulose, polystyrene, poly(vinylchloride), chlorinated rubbers, polyisobutylene, butadiene-styrene copolymers, vinyl chloride-vinylacetate copolymers, copolymers of vinylacetate and vinylchloride, poly(vinyl alcohol) and polycarbonates.

Photothermographic materials can contain development modifiers that function as speed increasing compounds, sensitizing dyes, hardeners, antistatic layers, plasticizers and lubricants, coating aids, brighteners, absorbing and filtered dyes, such as described in *Research Disclosure,* June 1978, Item No. 17029 and *Research Disclosure,* December 1978, Item No. 17643.

The thermally processable elements according to the invention comprise a variety of supports. Examples of useful supports include poly(vinylacetal) film, polystyrene, film, poly(ethyleneterephthalate) film, polycarbonate film and related films or resinous materials, as well as glass, paper, metal and other supports which can withstand the thermal processing temperatures.

The layers, including the overcoat, of thermally processable elements according to the invention are coated on a support by coating procedures known in the photographic art, including dip coating, air knife coating, curtain coating or extrusion coating using hoppers. If desired, two or more layers are coated simultaneously.

Spectral sensitizing dyes are useful in the described photothermographic materials to confer additional sensitivity to the elements and compositions. Useful sensitizing dyes are described in, for example, *Research Disclosure,* June 1978, Item No. 17029 and *Research Disclosure,* December 1978, Item No. 17643.

A photothermographic material preferably comprises a thermal stabilizer to help stabilize the photothermographic material prior to imagewise exposure and thermal processing. Such a thermal stabilizer aids improvement of stability of the photothermographic material during storage. Preferred thermal stabilizers are:

(a) 2-bromo-2-arylsulfonylacetamides, such as 2-bromo-2-p-tolysulfonylacetamide, (b) 2(tribromomethyl sulfonyl)benzothiazole and (c) 6-substituted-2,4-bis(tribromomethyl)-s-triazines, such as 6-methyl or 6-phenyl-2,4-bis(tribromomethyl)-s-triazine.

The thermally processable elements according to the invention are imagewise exposed by means of various forms of energy in the case of silver halide photothermographic elements. Such forms of energy include those to which the photosensitive silver halide is sensitive and encompass the ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) forms or coherent (in phase) forms as produced by lasers. Exposures are monochromatic, orthochromatic, or panchromatic copending upon the spectral sensitization of the photographic silver halide. Imagewise exposure is preferably for a sufficient time and intensity to produce a developable latent image in the photothermographic material. After imagewise exposure of the photothermographic material, the resulting latent image is developed merely by overall heating the element to moderately elevated temperatures. This overall heating merely involves heating the photothermographic element to a temperature within the range of about 90° C., to about 150° C., until a developed image is produced, such as within about 0.5 to about 60 seconds. By increasing or decreasing the length of time of heating, a higher or lower temperature within the described range is useful depending upon the desired image, the particular components of the photothermographic material and heating means. A preferred processing temperature is within the range of about 100° C. to about 130° C.

In the case of thermographic elements, the thermal energy source and means for imaging purposes can be any imagewise thermal exposure source and means that are known in the thermographic imaging art. The imagewise heating means can be, for example, an infrared heating means, laser, microwave heating means or the like.

Heating means known in the photothermographic and thermographic art are useful for providing the desired processing temperature range. The heating means is, for example, a simple hot plate, iron, roller, heated drum, microwave heating means, heated air or the like.

Thermal processing is preferably carried out under ambient conditions of pressure and humidity. Conditions outside normal atmospheric pressure and humidity are useful if desired.

The components of the thermally processable element according to the invention can be in any location in the element according to the invention which provides the desired image. If desired, one or more components of the photothermographic element according to the invention are in one or more layers of the element. For example, in some cases, it is desirable to include certain percentages of the reducing agent, toner, stabilizer precursor and/or other addenda in the overcoat layer over the photothermographic layer of the element. This, in some cases, reduces migration of certain addenda in the layers of the photothermographic element.

It is necessary that the components of the imaging combination be "in association" with each other in order to produce the desired image. The term "in association" herein means that in a photothermographic element the photosensitive silver halide and the image-forming combination are in a location with respect to each other which enables the desired processing and produces a useful image.

Thermographic elements on which the described overcoat is useful include any that are compatible with poly(silicic acid). Such thermographic elements include those described in, for example, U.S. Pat. Nos. 2,663,657; 2,910,377; 3,028,254; 3,031,329 and 3,080,254, the disclosure of which are incorporated herein by reference. An example of a useful thermographic element comprises a support bearing a thermographic layer comprising materials designed for electrically activated recording and thermography known in the imaging arts, and an overcoat layer comprising at least 50% by weight poly(silicic acid).

The term water soluble herein means at least 2 grams of the compound or compositions dissolves in one liter of water within 2 hours at 90° C.

The following examples further illustrate the invention.

EXAMPLES 1-3

I. Preparation of Control:

A control photothermographic element was prepared having the following composition:

| | mg/ft$^2$ |
|---|---|
| Overcoat: | |
| Photographic gelatin | 161.0 |
| Matte | 10.0 |
| Formaldehyde | 4.2 |
| Surfactant (Surfactant 10G which is p-isononylphenoxypolyglycidol, a trademark of and available from the Olin Corp., U.S.A.) | 4.7 |
| Photothermographic Layer: | |
| Silver Behenate (Ag) | 80.0 |
| $HgBr_2$ (Hg) | 0.1 |
| AgBr (Ag) | 40.0 |
| NaI | 3.5 |
| Succinimide toner/development modifier | 42.0 |
| Surfactant (SF-96 which is a polysiloxane fluid and is available from and a trademark of General Electric Co., U.S.A.) | 1.5 |
| Monobromo stabilizer: | 6.0 |

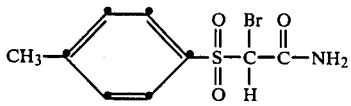

| | |
|---|---|
| Naphthyltriazine stabilizer: | 6.0 |

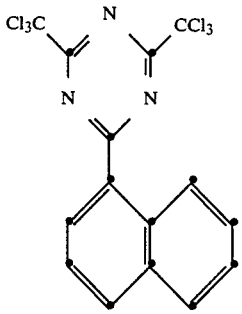

| | |
|---|---|
| Poly(vinyl butyral) binder (Butvar B-76 a trademark of the Monsanto Co., U.S.A.) | 400.0 |
| Sensitizing dye | 0.5 |
| Benzenesulfonamidophenol developing agent: | 100.0 |

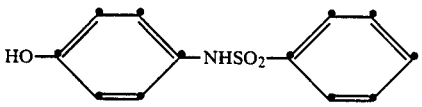

| | |
|---|---|
| MIBK solvent | 30.0 |

Support 4 mil blue poly(ethylene terephthalate) film

In the following examples only the compositions of the overcoats will be specified. The composition of the photothermographic layer used throughout the examples is as described above.

II. Hydrolysis of tetraethyl orthosilicate (TEOS) to form poly(silicic acid) (PSA)

The following components were mixed in the following order:

| | |
|---|---|
| Distilled Water | 144 g |
| 1N—p-Toluenesulfonic Acid | 36 g |
| Ethyl Alcohol | 200 g |
| TEOS | 208 g |

A clear solution of PSA was obtained in less than 10 minutes.

III. Solution of Poly(vinyl alcohol)(PVA)

An aqueous solution of 8% by weight poly(vinyl alcohol) in water was prepared. (8% by weight ELVANOL 52/22 in water. ELVANOL 52/22 is a trademark of E. I. duPont deNemours U.S.A.)

IV. The following PSA/PVA solutions were prepared:

| | A | B |
|---|---|---|
| Ratio $\frac{Si(OH)4}{PVA}$ = | 0.75 | 1.25 |
| 8% PVA, Elvanol 52/22 | 125.0 g | 125.0 g |
| Distilled Water | 79.0 g | 48.5 g |
| PSA solution | 46.0 g | 76.5 g |
| TOTAL | 250.0 g | 250.0 g |

V. The following POLY(VINYL ALCOHOLS) were used:

| | Viscosity (CPS) | % Hydrolysis | Soln. pH |
|---|---|---|---|
| *ELVANOL 71/30 | 27–33 | 99.0–99.8 | 5.0–7.0 |
| *ELVANOL 52/22 | 21–25 | 86.5–89 | 5.0–7.0 |
| *ELVANOL 85/82 | 24–32 | 99.0–99.8 | 5.0–7.0 |
| *ELVANOL 90/50 | 12–15 | 99.0–99.8 | 5.0–7.0 |
| *ELVANOL 50/42 | 40–46 | 86.5–89 | 5.0–7.0 |
| **VINOL 165 | 55–65 | 99.3+ | 5.5–7.5 |
| **VINOL 325 | 26–30 | 98.0–98.8 | 5.0–7.0 |
| **VINOL 425 | 26–30 | 95.5–96.5 | 4.5–6.5 |
| **VINOL 523 | 22–26 | 87.0–89.0 | 4.0–6.0 |

*means trademark of and available from E.I. duPont deNemours Co., U.S.A.
**means trademark of and available from Air Products & Chemicals, Inc., U.S.A.

VI. The following analytical methods were used:

(a) Determination of retained succinimide and MIBK (4-methyl-2-pentanone)

A known area of the coated material was extracted in acetone and water with N-methylsuccinimide as an internal standard. One microliter of the extract was injected into a 30M, DB-5 fused silica capillary column. Authentic standards, retention times, and a flame ionization detector provided identification and quantitation.

(b) Overcoat cracking defect test

A 5 foot strip of film or five 12 inch×35 mm strips of film were placed in a metal film can, along with a 14 gr. packet of Linde Molecular Sieves (drying agent). The strips, after sealing the box, were incubated for 4 days at 60° C., then the samples are visually inspected for the presence of the overcoat cracks. An overcoat consisting of gelatin is used as the control.

(c) Image smear

Due to differential thermal expansion behavior of the layers comprising the film, the microimage characters placed in close vicinity of the edge (1 to 4 mm) suffer undesirable deformation during thermal processing. The evaluation for an overcoat propensity to give image smear, consists of microscopic evaluation of images on the edge of the film and reporting the magnitude in arbitrary units from 0 (no smear) to 10+++ (worst smear). The image smear of 3–5 at 1.6 mm is considered to be acceptable. Image smear value of near 0 is highly desirable.

(d) Belt marks

A standard strip of exposed Kodak Dacomatic DL film, or of an experimental material under test, is heat developed using a standard Kodak Komstar Processor. (Kodak, Dacomatic DL, and Komstar are trademarks of Eastman Kodak Company, U.S.A.) It is the usual practice to pass the strips so that the base of the film contacts the heated drum and the overcoat remains, during processing, in contact with the processing woven belt. Any surface distortions arising as the result of contact between the overcoat and the belt is reported as "Belt Marks".

VII. Effect of PSA/PVA ratio on the barrier properties of the overcoat

The photothermographic element in I was overcoated with PSA/PVA in which the ratio of PSA to PVA was varied between 0 and 1.5. The resulting elements were analyzed for retained succinimide (raw stock and strips heated for 2 minutes at 130° C.), the results are tabulated in Table I as follows:

TABLE I

| | | SUCCINIMIDE | | | |
|---|---|---|---|---|---|
| Example No. | Overcoat | Raw Stock* mg/ft²** | 2 min. @ 130° mg/ft² | % Loss | Belt Marks |
| Comparative Example A | PVA = Elvanol 52/22 | | <0.1 | 100 | severe |
| Comparative Example B | PSA/PVA = 0.50 | | 8.1 | 76 | severe |
| Comparative Example C | 0.75 | | 22.7 | 32 | moderate |
| Example 1 | 1.00 | | 34.1 | 0 | slight |
| Example 2 | 1.25 | | 36.9 | 0 | none |
| Example 3 | 1.50 | | 38.3 | 0 | none |
| Comparative Example D | Gelatin Control | | 35.8 | 0 | none |

*Raw Stock herein means the unexposed and unprocessed element.
**Examples A, B, C, D, 1, 2 and 3: 34.1 + or −1.5 mg/ft². This value is the average mg/ft² and standard deviation for the individual coatings.

The results indicate that the partially hydrolysed PVA (Elvanol 52/22) alone is an extremely poor barrier toward succinimide, but it becomes satisfactory when it is coated as a mixed layer with PSA, when the ratio of PSA/PVA is at least 1.0.

EXAMPLES 4–9

Effect of polyvinyl alcohols

The photothermographic element described in I in Example 1 was overcoated with one of the overcoats specified in following Table II. The ratio of PSA/PVA in Examples 4–9 was 1.25. The raw stock and materials heated for 2 minutes at 130° C. were analyzed for the retained succinimide. The results were tabulated as follows in Table II:

TABLE II

| Example No. | Overcoat | SUCCINIMIDE Raw Stock mg/ft$^2$ | 2 min. @ 130° mg/ft$^2$ | % Loss | Belt Marks |
|---|---|---|---|---|---|
| Comparative Example E | PVA = Elvanol 71/30 | : | 16.6 | 29.2 | severe |
| Comparative Example F | PVA = Elvanol 85/82 | : | <0.1 | all | severe |
| Comparative Example G | PVA = Vinol 325 | 44.5 +/− 1.6* | <0.1 | all | severe |
| Comparative Example H | PVA = Vinol 425 | : | <0.1 | all | severe |
| Comparative Example I | PVA = Vinol 523 | : | <0.1 | all | severe |
| Comparative Example J | PVA = Elvanol 55/22 | : | <0.1 | all | severe |
| Example 4 | PSA/PVA-Elvanol 71/30 | : | 46.0 | 0.0 | none |
| Example 5 | PSA/PVA-Elvanol 85/82 | : | 44.1 | 2.8 | none |
| Example 6 | PSA/PVA-Vinol 329 | 46.0 +/− 1.0** | 43.2 | 4.1 | none |
| Example 7 | PSA/PVA-Vinol 425 | : | 44.6 | 1.4 | none |
| Example 8 | PSA/PVA-Vinol 523 | : | 43.7 | 2.1 | none |
| Example 9 | PSA/PVA-Elvanol 52/22 | : | 41.6 | 3.7 | none |
| Control | GEL Control | : | 44.0 | 2.0 | none |
| Control | GEL Control | 45.9 | 42.4 | 3.5 | |
| Control | GEL Control | 45.0 | 43.3 | 1.7 | |

*Examples E through J: This value is the average mg/ft$^2$ and standard deviation for the individual coatings.
**Examples 4 through 9: This value is the average mg/ft$^2$ and standard deviation for the individual coatings.

The results in Table II show that the polyvinyl alcohols are poor barriers toward succinimide compared to PSA/PVA coated at the ratio of 1.25. The PSA/PVA compositions, irrespective of the polyvinyl alcohol used, are comparable to the gelatin control in terms of the loss of succinimide during heating at 130° C. The PSA/PVA overcoats are free of undesirable processing pattern (belt marks).

EXAMPLES 10–12

Effect of PSA/PVA ratio

The photothermographic element described in I in Example 1, containing varying amounts of a polyvinyl alcohol (Elvanol 71/30). Gelatin overcoat was used as the control. Loss of succinimide on heating the material for 2 minutes at 130° C., and the degree of processing pattern formation are tabulated in Table III as follows:

TABLE III

| Example No. | Overcoat | Composition PSA/PVA | % Loss 2 min. @ 130° | Marks |
|---|---|---|---|---|
| Control Composition | GEL Control | — | 26* | none |

TABLE III-continued

| Example No. | Overcoat | Composition PSA/PVA | % Loss 2 min. @ 130° | Marks |
|---|---|---|---|---|
| Example K | PSA/PVA | 0.33 | 59 | severe |
| Example L | " | 0.67 | 23 | moder. |
| Example M | " | 0.89 | — | moder. |
| Example 10 | " | 1.00 | 14 | slight |
| Example 11 | " | 1.33 | 9 | none |
| Example 12 | " | 1.33 | 5 | none |

*The loss of succinimide is dependent on the ambient humidity during the test — the loss is higher at a higher humidity.

The results in Table III indicate improvement in the barrier properties as the amount of PSA increases in the overcoat layer. Although succinimide loss at PSA/PVA ratio of 0.67 is already lower than for the gelatin control, the belt marks are eliminated only when the ratio increases to over 1.0.

EXAMPLE 13–18

Effect of PSA/Water soluble cellulose acetate (WSCA) ratio on the barrier properties of the overcoat The photothermographic element described in I in Example 1 was overcoated with PSA/WSCA in which the ratio of PSA to WSCA was varied between 0 and 1.25. The resultant coatings were analyzed for retained succinimide (raw stock and strips heated for 2 minutes at 130° C.). The results are tabulated in Table IV as follows:

TABLE IV

| Example No. | PSA/WSCA | SUCCINIMIDE Raw Stock mg/ft$^2$ | 2 min. @ 130° C. mg/ft | % Loss | Adhesion |
|---|---|---|---|---|---|
| Comparative Control | GEL Control | : | 35.4 | 3 | poor |
| Example N | WSCA | : | 20.6 | 43 | poor |
| Example 13 | PSA/WSCA, Ratio = 0.50 | : | 33.6 | 8 | good |
| Example 14 | 0.75 | : | 33.1 | 9 | good |
| Example 15 | 1.00 | 36.4 +/− 0.8* | 35.0 | 4 | good |
| Example 16 | 1.25 | : | 32.9 | 10 o/c | cracks |
| Example 17 | PSA/PVA, Ratio 1.25,** | : | 35.4 | 3 | good |

TABLE IV-continued

| Example No. | PSA/WSCA | SUCCINIMIDE Raw Stock mg/ft$^2$ | 2 min. @ 130° C. mg/ft | % Loss | Adhesion |
|---|---|---|---|---|---|
| Example 18 | PSA/PVA, Ratio 1.25, Standard | : | 35.0 | 4 | good |

*This value represents the average mg/ft$^2$ and standard deviation for the individual coatings in Table IV.
**Without ethanol The water soluble cellulose acetate contained 16.5% acetyl.

The invention has been described in detail with particular reference to preferred embodiments thereof, but it will be understood that variations and modifications can be effected within the spirit and scope of the invention.

What is claimed is:

1. In a photothermographic or thermographic imaging element comprising a support, bearing a photothermographic or thermographic imaging layer and an overcoat layer, the improvement wherein the overcoat layer comprises 50% to 90% by weight poly(silicic acid) represented by the formula:

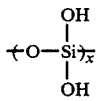

wherein x is an integer within the range of at least 3 to about 600 and comprises a water soluble hydroxyl containing polymer or monomer that is compatible with poly(silicic acid).

2. An imaging element as in claim 1 wherein the overcoat layer comprises 1 to 50% by weight water soluble poly(vinyl alcohol).

3. A photothermographic element comprising a support bearing a photothermographic silver halide emulsion layer and an overcoat layer comprising 50% to 90% by weight poly(silicic acid) represented by the formula:

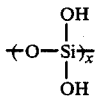

wherein x is an integer within the range of at least 3 to about 600 and comprising a water soluble hydroxyl containing polymer or monomer that is compatible with poly(silicic acid).

4. A photothermographic element as in claim 3 wherein the overcoat layer comprises 1 to 50% by weight water soluble poly(vinyl alcohol).

5. A photothermographic element as in claim 3 wherein the overcoat layer comprises 50% to 90% by weight poly(silicic acid) and 1 to 50% by weight water soluble poly(vinyl alcohol).

6. A photothermographic element as in claim 3 wherein the overcoat comprises 1 to 50% by weight water soluble poly(vinyl alcohol) which is 80 to 99% hydrolyzed.

7. A photothermographic element as in claim 3 wherein the photothermographic layer comprises a poly(vinyl butyral) binder.

8. A photothermographic element comprising a support bearing in reactive association, in a binder, (a) photographic silver halide, (b) an image-forming combination comprising (i) an organic silver salt oxidizing agent, with (ii) a reducing agent for the organic silver salt oxidizing agent, (c) a toning agent;

and having an overcoat layer comprising 50% to 90% by weight poly(silicic acid) represented by the formula:

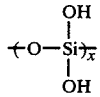

wherein x is an integer within the range of at least 3 to about 600 and comprising a water soluble hydroxyl containing polymer or monomer that is compatible with poly(silicic acid).

9. A photothermographic element as in claim 8 comprising a support bearing in reactive association, in a poly(vinyl butyral) binder, (a) photographic silver halide, (b) an image-forming combination comprising (i) silver behenate, with (ii) a phenolic reducing agent for the silver behenate, (c) a succinimide agent, and (d) an image stabilizer;

and having an overcoat layer comprising 50% to 90% by weight poly(silicic acid) represented by the formula:

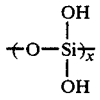

wherein x is an integer within the range of at least 3 to about 600 and comprising a water soluble hydroxyl containing polymer or monomer that is compatible with poly(silicic acid).

10. In a thermographic element comprising a support bearing a thermographic layer and an overcoat layer, the improvement wherein the overcoat layer comprises 50% to 90% by weight poly(silicic acid) represented by the formula:

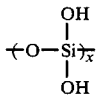

wherein x is an integer within the range of at least 3 to about 600 and comprises a water soluble hydroxyl containing polymer or monomer that is compatible with poly(silicic acid).

11. A thermographic element as in claim 10 wherein the overcoat comprises 1 to 50% by weight water soluble poly(vinyl alcohol).

12. A thermographic element as in claim 10 comprising a thermographic layer comprising a poly(vinyl butyral) binder.

* * * * *